US005852991A

United States Patent [19]

Yamamura et al.

[11] Patent Number: 5,852,991

[45] Date of Patent: Dec. 29, 1998

[54] OIL PAN ASSEMBLY FOR INTERNAL COMBUSTION ENGINE

[75] Inventors: Hideki Yamamura, Yokohama; Noriomi Okamoto, Kanagawa, both of Japan

[73] Assignee: Nissan Motor Co., Ltd., Yokohama, Japan

[21] Appl. No.: 955,457

[22] Filed: Oct. 21, 1997

[30] Foreign Application Priority Data

Oct. 21, 1996 [JP] Japan ..... 8-277639
Oct. 21, 1996 [JP] Japan ..... 8-277640

[51] Int. Cl.[6] ..... F02F 7/00

[52] U.S. Cl. ..... 123/195 C; 123/198 E; 184/106

[58] Field of Search ..... 123/195 C, 195 H, 123/195 R, 198 E; 184/106

[56] References Cited

U.S. PATENT DOCUMENTS

| | | | |
|---|---|---|---|
| 3,189,126 | 6/1965 | May | 184/106 |
| 3,653,464 | 4/1972 | Jacobsen et al. | 184/106 |
| 4,669,432 | 6/1987 | Harada | 123/195 C |
| 4,848,293 | 7/1989 | Sasada et al. | 184/106 |
| 4,876,998 | 10/1989 | Wunsche | 123/195 H |
| 5,058,545 | 10/1991 | Hirai et al. | 184/106 |
| 5,103,782 | 4/1992 | Matsui | 123/195 C |
| 5,136,993 | 8/1992 | Ampferer et al. | 123/195 C |
| 5,158,053 | 10/1992 | Krechberger et al. | 184/106 |
| 5,465,692 | 11/1995 | Uraki et al. | 123/195 H |
| 5,469,822 | 11/1995 | Mechsner | 123/195 C |
| 5,531,196 | 7/1996 | Clark | 184/106 |
| 5,662,080 | 9/1997 | Isono et al. | 184/106 |

*Primary Examiner*—David A. Okonsky
*Attorney, Agent, or Firm*—Foley & Lardner

[57] ABSTRACT

An oil pan for an internal combustion engine is an assembly of a tank member defining a deep interior space section for storing a lubricating oil, and a main frame member having a shallow bottom defining a shallow interior space section for collecting the oil. The main frame member further includes first and second side walls defining a bottomless open interior space section for leading the oil from the shallow interior space section into the deep space section. The main member is further formed with at least one transverse bridge extending over the bottomless open space section between the side walls to improve the rigidity. The transverse bridge is reinforced by a longitudinally extending projection such as a thin wall rib projecting laterally from one of the side walls or a flow regulating barrier projecting upward from the shallow bottom.

21 Claims, 5 Drawing Sheets

OIL PAN ASSEMBLY FOR INTERNAL COMBUSTION ENGINE

The contents of prior Japanese Patent Applications Nos. 8-277640 and 8-277639 both having a filing date of 21 Oct. 1996 in Japan are hereby incorporated by reference.

BACKGROUND OF THE INVENTION

The present invention relates to improvements in an oil pan structure for an internal combustion engine.

Many models of internal combustion engines for automobiles or other vehicles or facilities employ an oil pan having shallow and deep sections. The oil pan is fastened to a lower end of an engine cylinder block. The oil pan collects and stores the lubricating oil, and an oil pump sucks the oil from the oil pan and distributes the oil to various portions of the engine. In one conventional example, the oil pan is an assembly of an oil pan main frame member made by casting of metal such as aluminum alloy, and a tank member of press-formed metal sheet or plate, joined to the underside of the main member to form the deep section. The cast main member is relatively high in rigidity and serves as a reinforcing member for reinforcing the skirt of the cylinder block.

In this conventional example, the lower side of the main frame member is divided into a closed area closed by a shallow bottom defining the shallow section, and a rectangular open area opening downwards into the deep section. The rectangular open area is bounded along the transverse direction between left and right upright side walls, and along the longitudinal direction between a front upright end wall and an end of the shallow bottom.

The end of the shallow bottom extends in the transverse direction and spans the wide open area so that the rigidity of the shallow bottom is lower. Specifically, the marginal region along the end of the shallow bottom is liable to suffer vibrations such as membrane vibrations of thin plates or diaphragms, and constitutes one of major factors increasing the noise of the engine. Furthermore, the left and right upright side walls framing the rectangular opening are inferior in the opening and closing rigidity (or transverse rigidity) and torsional rigidity. Therefore, the skirt of the cylinder block is less rigid in the front portion just above the rectangular opening of the oil pan, and tends to undergo the opening and closing mode as shown in FIGS. 8A and 8B, and the torsional mode as shown in FIGS. 8C~8F.

To increase the wall thickness of the oil pan and/or the bulkhead of the cylinder block is one way to reduce the engine noise. However, the thick wall increases the weight of the engine.

SUMMARY OF THE INVENTION

It is therefore an object of the present invention to provide an oil pan assembly which can improve the rigidity of an oil pan bottom and reduce the engine noise.

It is another object of the present invention to provide an oil pan assembly which can effectively reinforce an engine cylinder block without increasing the weight, and reduce the noise generated by the skirt of the cylinder block.

According to the present invention, an oil pan assembly for an internal combustion engine comprises at least a tank member and a main frame member. The tank member defines an oil storage deep interior space section. The main member has at least a shallow bottom defining a shallow interior space section for collecting the oil, and an upright wall enclosing an interior space. In an illustrated embodiment of the present invention, the interior space enclosed by the upright wall is divided into the above-mentioned shallow interior space section and a bottomless open interior space section for leading the oil from the shallow interior space section into the deep space section.

The upright wall includes at least first and second opposite side wall sections extending in a first direction such as a longitudinal direction and bounding the bottomless open space section therebetween. The oil pan assembly further comprises at least one transverse bridge extending in a second direction such as a transverse direction across the open space section and connecting the first and second side wall sections, and at least one longitudinal projection extending in the first direction and bracing the bridge and the frame structure formed by the upright wall and the shallow bottom. Preferably, the shallow bottom, upright wall, bridge and longitudinal projection are all integral parts of a metal casting. The longitudinal projection extends in the open space section and connects the bridge with one of the upright wall and the shallow bottom. The longitudinal projection is one of a horizontal thin wall projection, such as a thin wall rib, projecting in the second direction from the upright wall and a vertical thin wall projection, such as a flow regulating barrier, projecting upwards from the shallow bottom.

The transverse bridge serves as a transverse structural member and the longitudinal projection serves as a reinforcing member, a brace or a gusset plate. The transverse bridge and longitudinal projection increase the rigidity or stiffness of the oil pan and reinforce a skirt of an engine block effectively.

DETAILED DESCRIPTION OF THE INVENTION

FIGS. 1~4 show an oil pan assembly according to a preferred embodiment of the present invention. This oil pan assembly is designed for a four-cylinder in-line internal combustion engine.

Figure 1:
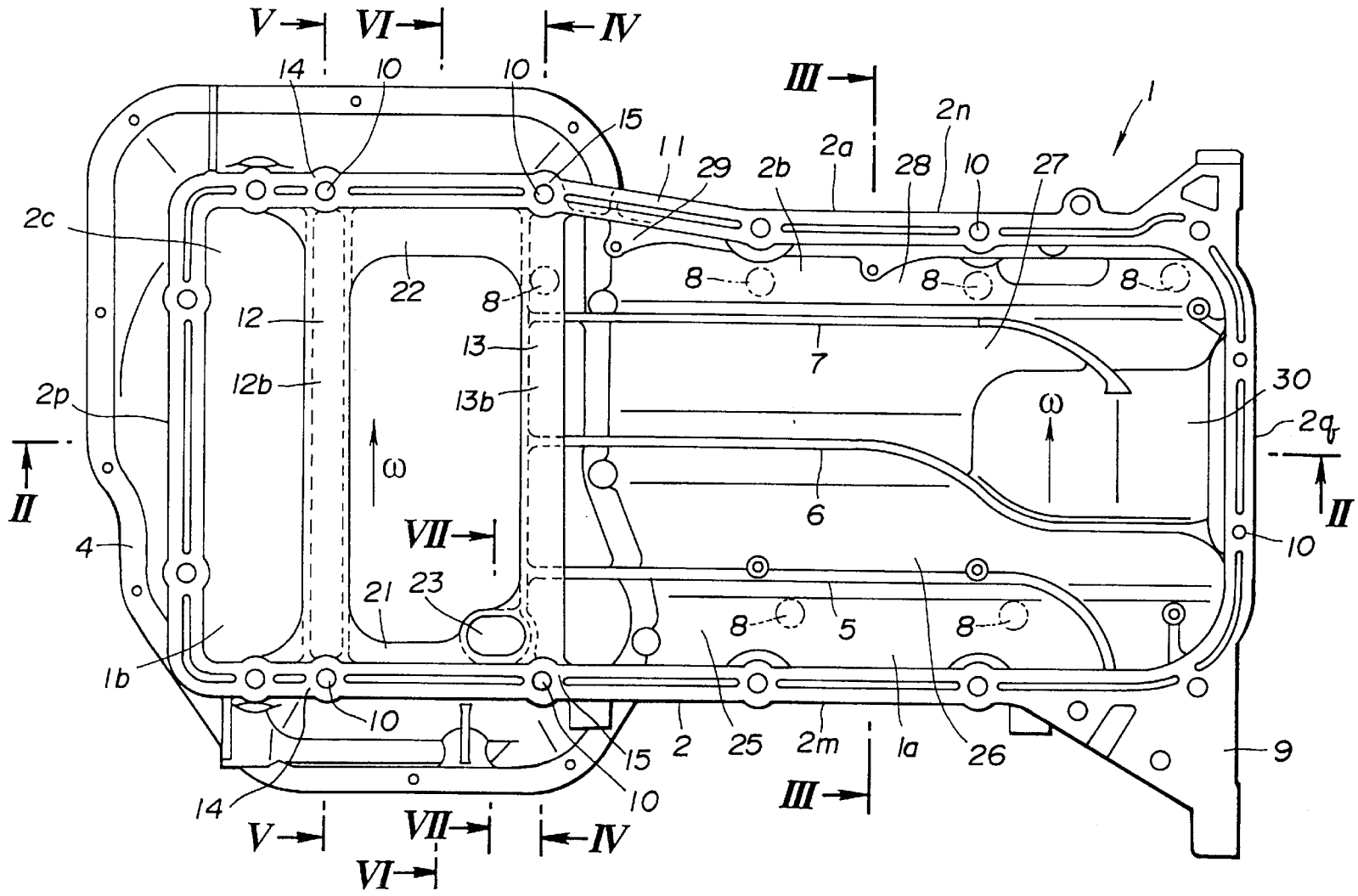
FIG. 1 is a plan view of an oil pan assembly according to one embodiment of the present invention.
Figure 2:
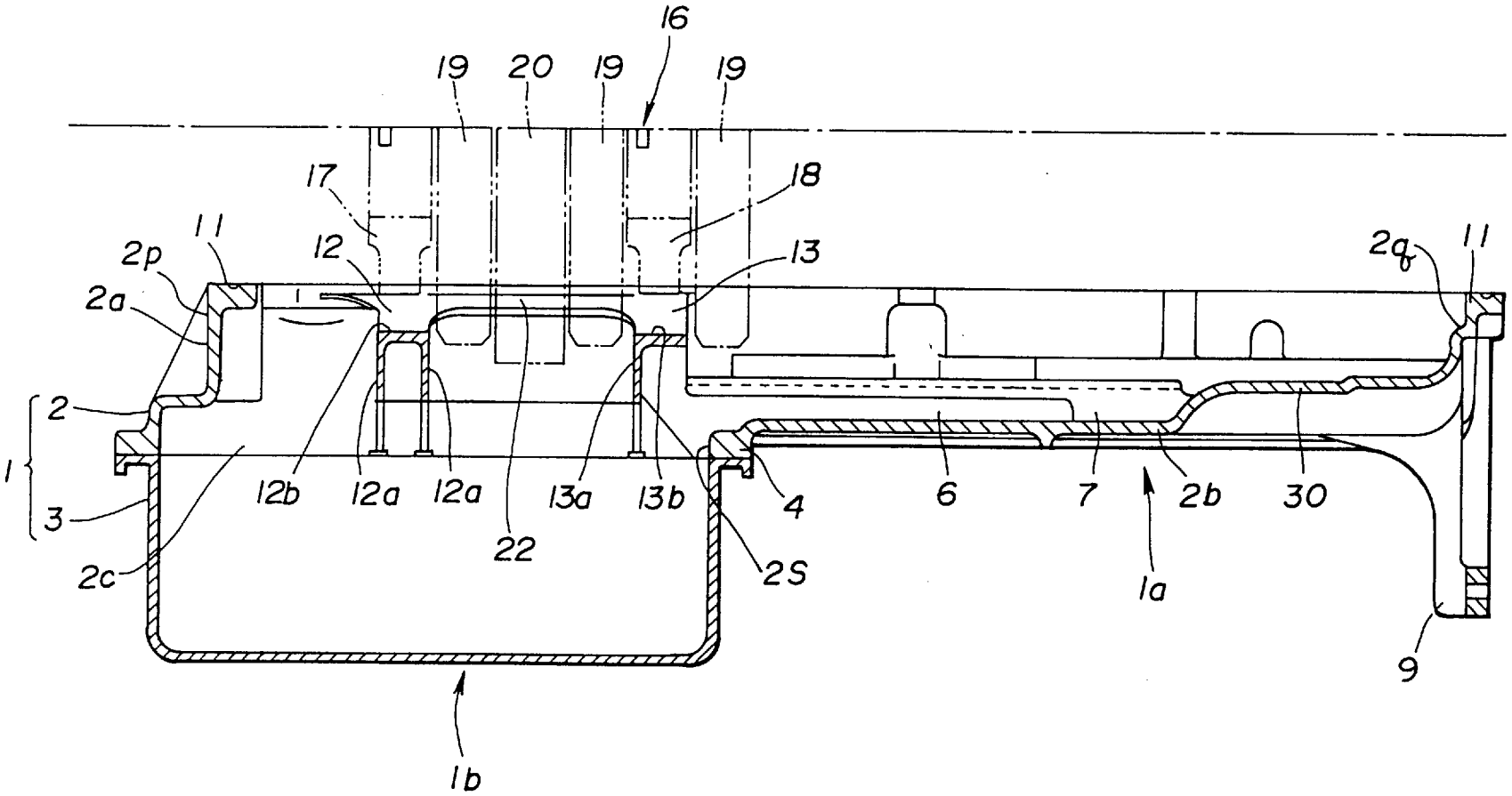
FIG. 2 is a longitudinal sectional view of the oil pan assembly taken across a line II—II of FIG. 1.

An oil pan 1 is adapted to be fixed to an underside of an engine cylinder block, more specifically to a lower end of a skirt. The oil pan 1 shown in FIGS. 1 and 2 is an assembly of an oil pan main frame member 2 and a tank member 3. The main frame member 2 and the tank member 3 are assembled into a bath-shaped container to which the lubricating oil returns by gravity. The main member 2 of this example is made by aluminum die casting, and the tank member 3 is made by press forming of sheet metal. The main member 2 has a shallow bottom 2*b* defining a shallow interior space section 1*a* for collecting a lubricating oil, and the tank member 3 comprises a deep bottom defining a deep interior space section 1*b* for storing the lubricating oil, as shown in FIG. 2. The shallow section 1*a* collects the oil and directs the oil into the deep section 1*b*.

The main member 2 further includes an upright wall 2*a* enclosing and defining an interior space which is divided into a bottomless open interior space section 2*c* and the above-mentioned shallow interior space section 1*a* closed on the underside by the shallow bottom 2*b*. The bottomless open space section 2*c* opens downwards into the deep section 1*b* formed by the tank member 3. The lubricating oil can flow on the shallow bottom 2*b* toward the bottomless open space section 2*c*, and fall from an end 2*s* of the shallow bottom 2*b* into the deep section 1*b* through the bottomless open section 2*c*.

The tank member 3 is located just under the front part of the internal combustion engine, and fixed to the underside of the oil pan main member 2. The main member 2 has a lower flange 4 having a joint surface facing downwards. The lower flange 4 surrounds and fringes the open underside of the bottomless open interior space section 2*c* of the main member 2. The tank member 3 is fixed to the lower flange 4 of the main member 2 by bolts (not shown). The main member 2 and the tank member 3 are thus assembled into a unit. The bottomless open space section 2*c* of the main member 2 is located on the tank member 3 under the front part of the engine, and the closed-bottom shallow space section 1*a* is located just under the rear part of the engine.

The oil pan main frame member 2 of this example is approximately rectangular as viewed in FIG. 1, and the upright wall 2*a* has first and second opposite side wall sections 2*m* and 2*n* extending along a first direction, and front and rear end wall sections 2*p* and 2*q* extending along a second direction. In this example, the first direction is a longitudinal direction of the oil pan assembly 1, and the second direction is a transverse, widthwise or lateral direction of the oil pan assembly 1. In the assembled state, the oil pan assembly 1 of this example is oriented so that the longitudinal direction of the oil pan assembly 1 is identical to the longitudinal direction of the engine, and the transverse direction of the oil pan assembly 1 is the transverse or lateral direction of the engine. The shallow bottom 2*b* extends along the longitudinal (first) direction from the rear end wall section 2*q* toward the front end wall section 2*p*, and terminates at the front bottom end 2*s*. The front bottom end 2*s* of the shallow bottom 2*b* extends along the transverse (second) direction from an intermediate point on the first side wall section 2*m* to an intermediate point on the second side wall section 2*n*. The oil collecting shallow space section 1*a* is formed on the shallow bottom 2*b* between the rear end wall section 2*q* and the front bottom end 2*s*, and bounded along the transverse direction between the first and second side wall sections 2*m* and 2*n*. The bottomless open section 2*c* is defined between the front end wall section 2*p* and the front end 2*s* of the shallow bottom 2*b*, and bounded along the transverse direction between the first and second side wall sections 2*m* and 2*n*. The front end wall section 2*p*, bottom end 2*s* and left and right side wall sections 2*m* and 2*n* define a rectangular opening of the bottomless open section 2*c*.

Figure 3:
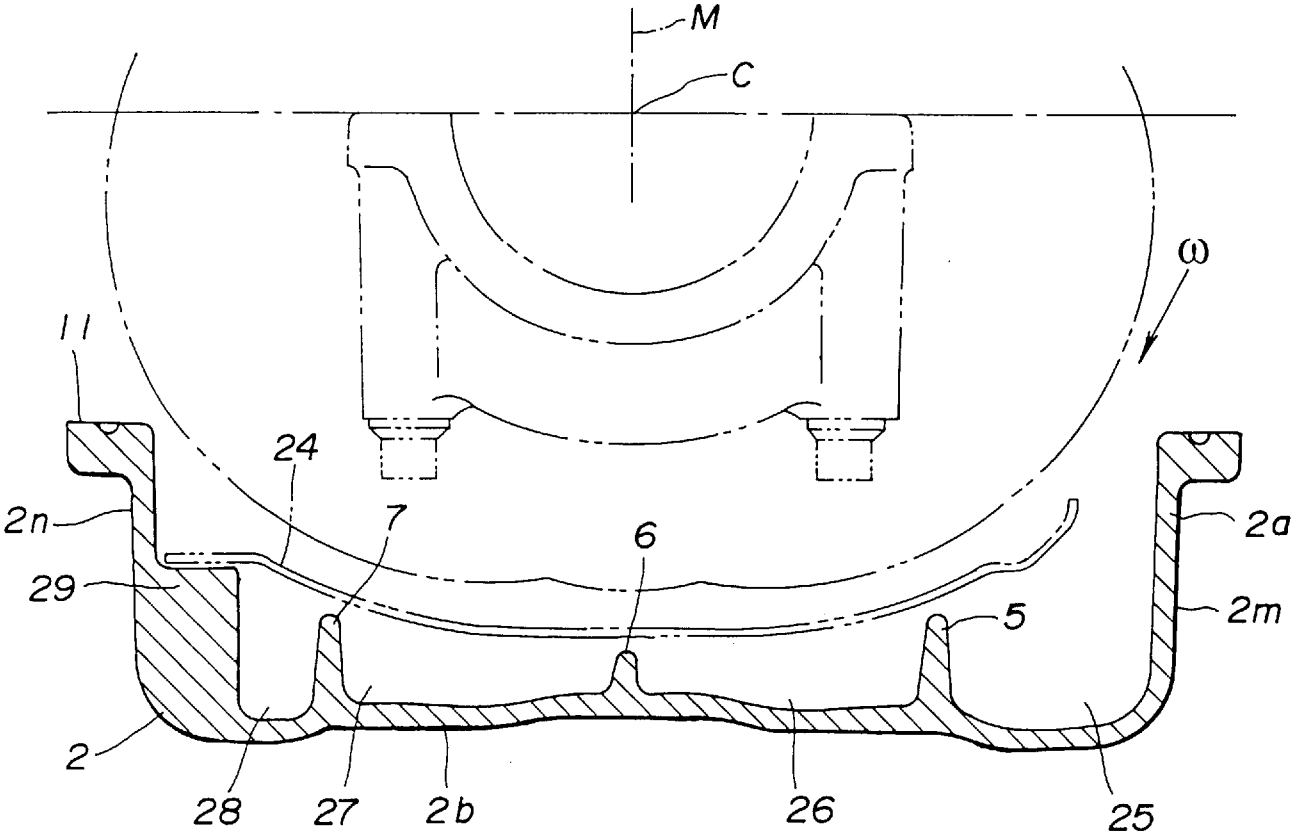
FIG. 3 is a lateral sectional view taken across a line III—III of FIG. 2.

A baffle plate 24 extends over the shallow bottom 2*b* of the shallow section 1*a*, and divides the oil collecting shallow space section 1*a* into an upper subspace (or chamber) over the baffle plate 24 and a lower subspace (or chamber) between the shallow bottom 2*b* and the baffle plate 24, as shown in FIG. 3.

The rear end portion of the oil pan main member 2 is formed with a transmission mounting portion 9 to which a transmission (not shown) is connected.

A plurality of bolt through holes 10 are formed in the upright wall 2*a* of the oil pan main member 2 as shown in FIG. 1. The oil pan assembly 1 is fastened to the cylinder block by bolts passing through these holes 10 in the assembled state. Each bolt hole 10 extends vertically from an upper open end to a lower open end.

An upper oil pan flange 11 is formed at the upper end of the upright wall 2*a*. The upper flange 11 forms an uppermost joint surface to be joined to a downwardly facing joint surface of a block flange of the cylinder block.

A crankshaft 16 of the engine is located just above the oil pan main member 2. Bearing caps 17 and 18 shown in FIG. 2 are arranged to support the crankshaft 16. The crankshaft 16 has counterweights 19 and connecting rods 20.

The first and second side wall sections 2*m* and 2*n* of the oil pan main member 2 extend in the longitudinal direction of the engine along an axis C of the crankshaft 6. In the view of FIG. 3, the engine crankshaft rotation is in a clockwise direction as shown by an arrow ω, the first side wall section 2*m* is on the right side and the second side wall section 2*n* is on the left. An imaginary vertical middle (or median) plane M containing the crankshaft axis C divides the oil pan assembly 1 into left and right halves, but each of the right and left halves is not an exact mirror image of the other. The oil pan assembly 1 of this example is roughly symmetrical with respect to the middle (or median) plane M, but the bilateral symmetry of the oil pan structure is not perfect. The first side wall 2*m* of the oil pan main member 2 is located on a first lateral side of the imaginary vertical middle plane M whereas the second side wall 2*n* is on a second lateral side opposite to the first lateral side. As viewed in FIG. 3 in which the engine rotation is clockwise as shown by the arrow (ω, the first lateral side is the right side of the middle plane M, and the second lateral side is the left side. The engine rotation about the crankshaft axis C is in the form of a downward angular motion on the first lateral side, and an upward angular motion on the second lateral side. With the engine rotation, a crankpin descends on the first lateral side, and ascends on the second lateral side.

At least one transverse bridge 12 or 13 extends along the transverse direction between the first and second side wall sections 2*m* and 2*n* across the bottomless open space section 2*c*. In this example, there are two bridges 12 and 13 extending in parallel to each other. The bridge 12 is located about the middle of the bottomless open section 2*c* and the bridge 13 is near the front bottom end 2*s* of the shallow bottom 2*b*. The front bridge 12 is located between the front end wall section 2*p* and the rear bridge 13, and the rear bridge 13 is between the front bridge 12 and the front bottom end 2*s* of the shallow bottom 2*b*.

The front bridge 12 extends between first and second bosses 14, and the rear bridge 13 extends between first and second bosses 15. Each boss 14 or 15 extends vertically and defines one of the through holes 10. Each boss 14 or 15 is approximately cylindrical and has upper and lower bases. The through hole 10 has an upper end opening in the center of the upper base, and a lower end opening in the center of the lower base. The front bridge 12 has a first lateral bridge end connected with, and supported by, the first boss 14 formed in the first side wall section 2*m*, and a second lateral bridge end connected with and supported by the second boss 14 formed in the second side wall section 2*n*. Similarly, the rear bridge 13 has a first lateral bridge end connected with and supported by the first boss 15 formed in the first side wall section 2*m*, and a second lateral bridge end connected with and supported by the second boss 15 formed in the second side wall section 2*n*. The bridges 12 and 13 supported by the bosses 14 and 15 can effectively increase the rigidity of the main member and the rigidity of the skirt of the engine cylinder block.

Figure 5:
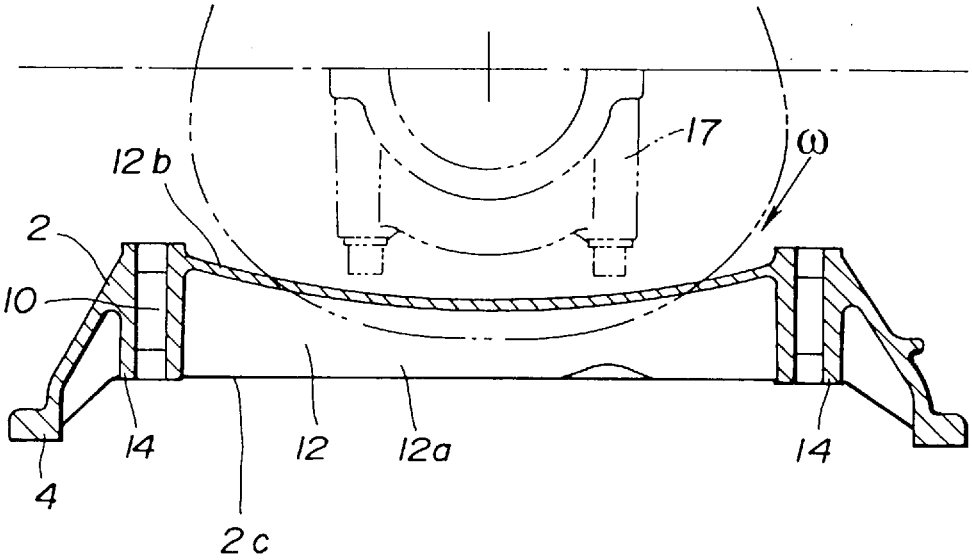
FIG. 5 is a lateral sectional view taken across a line V—V of FIG. 1.

The front bridge 12 is in the form of a channel beam or bar, and has an upper thin wall strip portion 12*b* and front and rear vertical thin wall portions 12*a* extending downwards from both sides of the upper wall portion 12*b*, as shown in FIG. 2. The upper wall portion 12*b* and the front and rear vertical wall portions 12*a* form a cross sectional shape resembling an inverted letter U. The lower edges of the vertical wall portions 12*a* extend horizontally and connect the lower bases of the bridge supporting bosses 14 continuously so as to define a flat horizontal plane as shown in FIG. 5. In this example, the lower edges of the vertical wall portions 12*a* and the lower bases of the bosses 14 extend in the imaginary common flat horizontal plane perpendicular to the imaginary median plane M.

Figure 4:
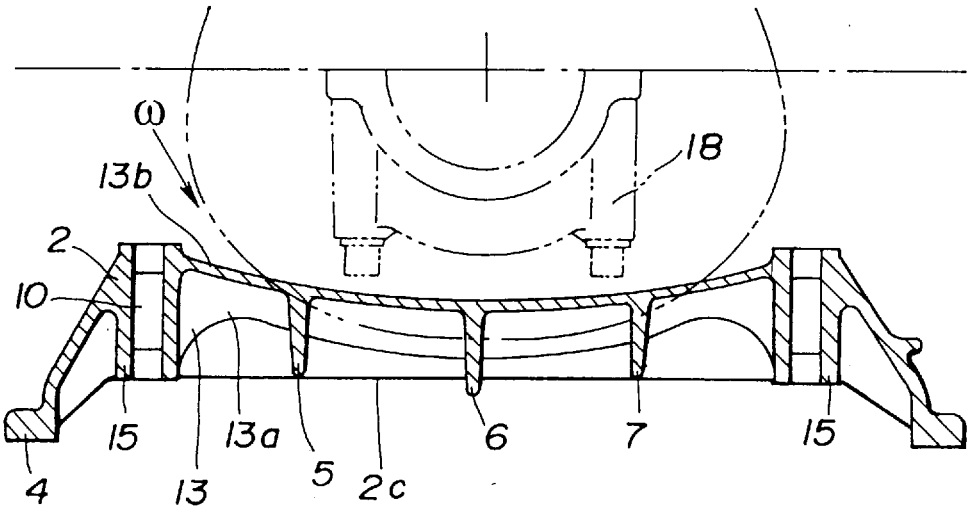
FIG. 4 is a lateral sectional view taken across a line IV—IV of FIG. 1.

The rear bridge 13 is in the form of an angle beam or bar, and has an upper thin wall strip portion 13*b* and a single vertical thin wall portion extending downwards from one side of the upper wall portion 13*b*. The rear bridge 13 is an L-shaped cross section formed by the upper wall portion 13*b* and the vertical wall portion 13*a*, as shown in FIG. 2. The lower edge of the vertical wall portion 13*a* extends along the front edge of the baffle plate 24 as shown in FIG. 4 so as to hold the height of the lower edge of the vertical wall portion 13*a* approximately equal to the height of the front edge of the baffle plate 24. The lower edge of the vertical wall portion 13*a* is located above the upwardly facing surface of the shallow bottom 2*b*. Thus, the vertical wall portion 13*a* of the rear bridge 13 is spaced from the shallow bottom 2*b* along the longitudinal direction and along the vertical direction so as to ensure the smooth, unobstructed flow of the lubricating oil from the shallow section 1*a* to the deep section 1*b*.

The angled cross sectional shape of each bridge 12 or 13 increases the rigidity of the bridge itself. The vertical dimension or height of each boss 14 or 15 is relatively long, and accordingly the vertical dimension or height of each bridge 12 and 13 are relatively long.

The front and rear bridges 12 and 13 are located just below the bearing caps 17 and 18, respectively, as shown in FIG. 2. The upper strip wall portions 12*b* and 13*b* are concave so as to avoid interference with the bearing caps 17 and 18, as shown in FIGS. 4 and 5. Each of the upper strip wall portions 12*b* and 13*b* has an upwardly facing strip surface extending in the transverse direction so as to describe a smooth curved line depressed deepest at the middle between the first and second side wall sections 2*m* and 2*n*. As shown in FIG. 2, the connecting rod 20 of the number 1 (#1) cylinder of the engine is located between the front and rear bridges 12 and 13.

At least one web-like rib 21 or 22 is formed in the main member 2. The rib is a longitudinally extending projection of a relatively thin wall. The rib projects from the first or second side wall sections 2*m* or 2*n* like a ledge, extends in the longitudinal direction and connects one of the side wall sections 2*m* and 2*n* with one of the bridges 12 and 13. In this example, there are formed two of the ribs 21 and 22. The first rib 21 projects from the first side wall section 2*m* substantially in the transverse direction and extends in the longitudinal direction from the front bridge 12 to the rear bridge 13. The second rib 22 projects from the second side wall section 2*n* substantially in the transverse direction and extends from the front bridge 12 to the rear bridge 13. Each of the ribs 21 and 22 is continuous and integral with the upper wall portions 12*b* and 13*b* of the front and rear bridges 12 and 13. In this example, the first and second ribs 21 and 22 and the upper wall portions 12*b* and 13*b* of the bridges 12 and 13 extend continuously so as to form a common smooth curved surface, and form a continuous rigid frame enclosing and reinforcing the rectangular opening.

Figure 6:
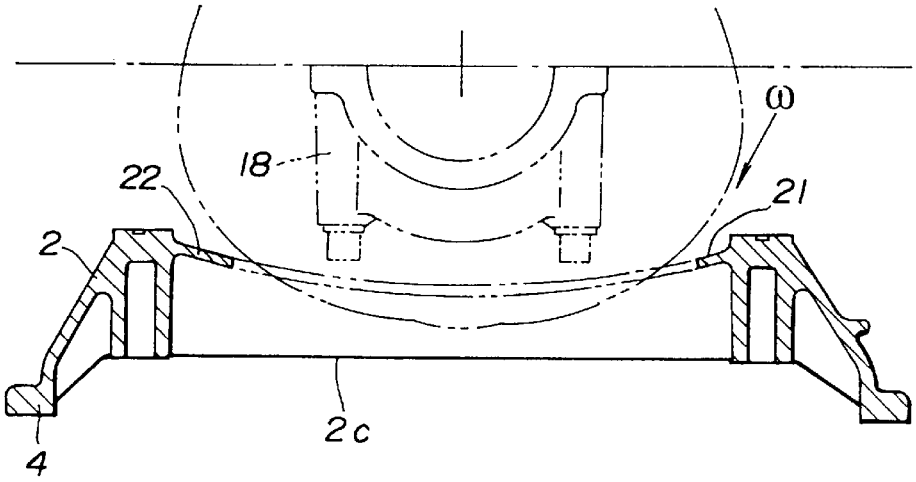
FIG. 6 is a lateral sectional view taken across a line VI—VI of FIG. 1.

The width of the first rib 21 measured along the transverse direction is smaller than the width of the second rib 22 as shown in FIGS. 1 and 6. The first rib 21 projects from the first side wall section 2*m* only slightly whereas the second rib 22 projects from the second side wall section 2*n* broadly toward the first side wall section 2*n*.

In the crankcase, the lubricating oil positively flows downwards along the wall surface on the first lateral side on which the crankpins descend. The narrower first rib 21 on the first lateral side increases the open space for allowing the downward flow, and reduce interference with the downward stream. The first rib 21 has an upper surface sloping downward along the transverse direction toward the center of the oil pan as shown in FIG. 6, and facilitates the downward flow of the lubricating oil.

On the second lateral side in the crankcase, the lubricating oil is forced upwards by the crankshaft rotation. The broader rib 22 on the second lateral side restrains the upward movement of the lubricating oil. The second thin wall rib 22 slopes down along the transverse direction toward the center, and prevents the upward oil movement on and near the inside surface of the second side wall section 2*n* of the oil pan. The rib 22 on the crankpin ascending second lateral side prevents the lubricating oil from being splashed upwards, and prevents air from being mingled and entrapped in the lubricating oil.

The first rib 21 has a front corner projecting alongside the front bridge 12 and connecting the first side wall section 2*m* and the first bridge 12, and a rear corner projecting alongside the rear bridge 13 and connecting the first side wall section 2*m* and the rear bridge 13. At the front corner, the edge of the rib 21 is smoothly curved like a circular arc. Similarly, the second rib 22 has front and rear corners connecting the second side wall section 2*n* with the front and rear bridges 12 and 13, respectively. At each corner, the edge of the rib 22 is smoothly curved like a circular arc. The corners serve as a gusset plate. At each corner, the rib 21 or 22 projects alongside the bridge 12 or 13 as far as possible within the limitation imposed by the rotating member of the crankshaft.

Figure 7:
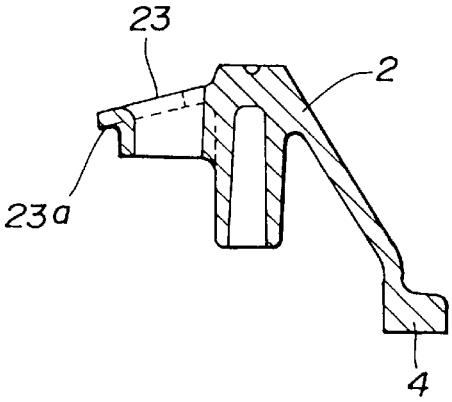
FIG. 7 is a partial sectional view taken across a line VII—VII of FIG. 1.
Figures 8A, 8B, 8C, 8D, 8E, 8F:
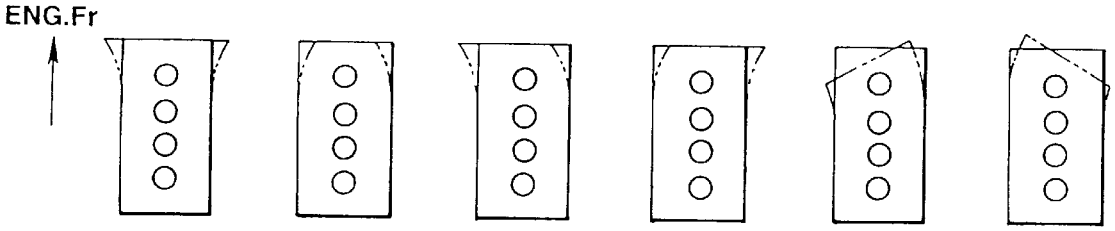
FIG.8A Prior Art FIG.8B Prior Art FIG.8C Prior Art FIG.8D Prior Art FIG.8E Prior Art FIG.8F Prior Art
FIGS. 8A~8F are schematic views for illustrating various vibration modes in the underside of an engine cylinder block.

In this example, the rear corner of the first rib 21 is formed with an oil gauge hole 23. The oil gauge hole 23 of this example is elongated along the first side wall section 2*m* like an ellipse, as shown in FIG. 1. Through this hole 23, it is possible to insert an oil level gauge from an upper hole formed in an upper portion of the engine, into the oil storage deep section 1*b* of the tank member 3. The oil gauge hole 23 is defined by a rim 23*a* as shown in FIG. 7. The rim 23*a* is L-shaped in cross section, and projects inwards as well as downwards from the vertex as shown in FIG. 7. The side wall surface defining the hole 23 extends vertically to a limited extent. The rim 23*a* connects the first rib 21 and the rear bridge 13. The rim 23*a* is continuous and integral with the first rib 21. The angled rim 23*a* braces the side wall section 2*m* and the bridge 13, and increases the rigidity of the narrower rib 21.

The bottom 2*b* of the oil pan shallow section 1*a* is formed with three longitudinal projections 5, 6 and 7 extending in the longitudinal direction of the engine. The longitudinal projections 5, 6 and 7 projects upward from the bottom 2*b* like ribs in the form of flow regulating barriers (or flow regulating plates). In this example, the flow regulating barriers 5, 6 and 7 are jointless integral parts of the oil pan main member 2. The flow regulating barriers 5, 6 and 7 extend through almost the full extent of the bottom 2*b* along the longitudinal direction. The flow regulating barriers 5, 6 and 7 divide the lower subspace between the bottom 2*b* and the baffle plate 4 into four channels 25, 26, 27 and 28 extending in the longitudinal direction of the engine.

The rear end segment of each flow regulating barrier is curved toward the first side wall section 2*m*, as shown in FIG. 1. In the view of FIG. 1, the rotating parts such as the counterweights 7 move in the transverse direction shown by arrows ω from the first side wall section 2*m* toward the second side wall section 2*n*. Therefore, the rear end of each of the channels 25, 26, 27 and 28 is curved toward the first side wall section 2*m*, and opens upstream toward the first side wall section 2*m*.

The second flow regulating barrier 6 is located directly below the axis C of the crankshaft 6. The imaginary vertical middle (or median) plane M containing the crankshaft axis C passes through the second barrier 6. The first and third barriers 5 and 7 are arranged roughly in a manner of bilateral symmetry with respect to the vertical middle plane M.

The oil pan main member 2 is formed with a plurality of bosses 29 which are smaller in height than the upper flange 11, as shown in FIG. 3. The bosses 29 project inward in the shallow interior space section 1*a*. Each boss 19 has an upwardly facing top surface. The baffle plate 4 is fixed to the top surfaces of the bosses 19 by bolts (not shown).

The oil pan main member 2 has a rear middle bulge 30 bulging upwards at the rear middle of the shallow section 1*a* to receive a part of the transmission. The cylinder block of the engine is formed with a plurality of oil holes for allowing the lubricating oil to fall toward the oil pan assembly 1. In FIG. 1, reference numerals 8 indicate the positions of these oil holes. The baffle plate 24 is formed with a plurality of oil collecting holes for allowing the oil to flow into the lower subspace under the baffle plate 24. The baffle plate 4 extends laterally from the second side wall section 2*n* toward the first side wall section 2*m* and terminates at an edge extending along the longitudinal direction near the first side wall section 2*m*. Between the first side wall section 2*m* and the edge of the baffle plate 4, there is formed an air inlet opening upwards for receiving a downward air stream from above along the first side wall section 2*m*.

As shown in FIGS. 1 and 2, each of the flow regulating barriers 5~7 has a front projection projecting forwards beyond the front end 2*s* of the shallow bottom 2*b* toward the front end wall section 2*p*. The front projection of each barrier projects upwards as well as forwards and has a front end connected with the vertical wall portion 13*a* of the rear bridge 13, and an upper end connected with the upper wall portion 13*b* of the rear bridge 13. The vertically extending thin wall of each barrier forms an angled corner with the vertical wall portion 13*a* along a vertically extending intersection line, and an angle corner with the horizontal upper wall portion 13*b* along an horizontal intersection line extending in the longitudinal direction. Between the vertical wall portion 13*a* and the front end 2*s* of the shallow bottom 2*b*, there is defined a long opening extending along the lateral or transverse direction. The long opening is divided by the projections of the three barriers 5, 6 and 7 into four small openings. Each of the channels 25~28 is connected with a unique one of the four small openings to form a continuous fluid bent passage for guiding the lubricating oil from the shallow section 1*a* into the deep section 1*b*. The opening size of each of the small openings in a plan view is approximately equal to the cross sectional area of the corresponding channel formed between the shallow bottom 2*b* and the baffle plate 24, so that the continuous fluid passage is approximately uniform in the cross sectional size.

The flow regulating barriers 5, 6 and 7 serve as reinforcing members and enhance the rigidity of the entirety of the shallow bottom 2*b*. The flow regulating barriers 5, 6 and 7 are rigidly connected with the first and second side wall sections 2*m* and 2*n* of the oil pan main member 2, through the rear bridge 13. This structure can significantly improve the rigidity of the shallow bottom 2*b*, specifically along the bottomless open space section 2*c*, and accordingly reduce the engine noise by preventing membrane vibrations of the shallow bottom 2*b*. Both ends of the second bridge 13 is connected with the bosses 15. Therefore, the bridge 13 is supported firmly by the cylinder block. The bridge 13 in the form of an angle bar is rigid and resistant to bending deformation.

The rectangular frame structure formed by the bridges 12 and 13 and the ribs 21 and 22 reinforces the flange 11 around the open section 2*c*, improves the rigidity, such as the torsional rigidity, of the oil pan assembly 1 and the cylinder block and reduce the engine noise.

In this embodiment, the bridges 12 and 13, the ribs 21 and 22, the flow regulating barriers 5, 6 and 7, the shallow bottom 2*b*, the upright wall 2*a*, the flange 11 and the bosses 14, 15 and 29 are all integral parts of the casting.

What is claimed is:

1. An oil pan assembly for an internal combustion engine, comprising:

a tank member comprising a deep bottom defining a deep interior space section for storing a lubricating oil;

a main member comprising a shallow bottom defining a shallow interior space section for collecting the oil, and an upright wall enclosing an interior space comprising the shallow interior space section and a bottomless open interior space section for leading the oil from the shallow interior space section into the deep space section, the bottomless open interior space section opening downwards into the deep interior space section; and wherein the upright wall comprises first and second opposite side wall sections extending in a first direction and bounding the shallow interior space section and the bottomless open space section between both side wall sections, and the main member further comprises a flow regulating barrier projecting upwards from the shallow bottom and extending along the first direction between the first and second side wall sections; and wherein the main member further comprises a transverse bridge which extends from the first side wall to the second side wall and which is connected with the flow regulating barrier.

2. An oil pan assembly as claimed in claim 1 wherein the upright wall of the main member is adapted to be fastened to a lower side of a cylinder block of the internal combustion engine, the main member is a casting, the tank member is a formed metal sheet, the first direction is a longitudinal direction of the engine, the bridge extends in a second direction which is a transverse direction of the engine, and connects the first and second side wall sections, and the bridge is an integral part of the casting.

3. An oil pan assembly as claimed in claim 1 wherein the bridge extends over the bottomless open interior space section, and the flow regulating barrier projects into the bottomless open interior space section beyond an end of the shallow bottom to the bridge.

4. An oil pan assembly as claimed in claim 3 wherein the main member comprises first and second bolt through holes for fastening the main member to a cylinder block of the engine, and the bridge comprises a first bridge end connected with the first side wall section at a position of the first through hole, and a second bridge end connected with the second side wall section at a position of the second through hole.

5. An oil pan assembly as claimed in claim 3 wherein the bridge is L-shaped in cross section, and comprises an upper wall portion and a lower wall portion extending downwards from one side of the upper wall portion.

6. An oil pan assembly as claimed in claim 5 wherein said upper wall portion of the bridge extends from a second side to a first side in a direction away from the shallow space section, and said lower wall portion of the bridge extends downward from said first side of said upper wall portion.

7. An oil pan assembly as claimed in claim 5 wherein the lower wall portion of the bridge extends downwards to a lower end which is located above an upper surface of the shallow bottom.

8. An oil pan assembly as claimed in claim 5 wherein the flow regulating barrier comprises a projection projecting beyond the end of the shallow bottom into the bottomless open interior space section to a forward end joined to the lower wall portion of the transverse bridge, and the projection of the flow regulating barrier extends upwards to an upper end joined to the upper wall portion of the transverse bridge.

9. An oil pan assembly as claimed in claim 1 wherein the main member further comprises a rib projecting from an inside wall surface of one of the first and second side wall sections, extending in the first direction along the inside wall surface and connecting the transverse bridge and the inside wall surface.

10. An oil pan assembly as claimed in claim 9 wherein the main member further comprises a second bridge extending from the first side wall section to the second side wall section over the bottomless open interior space section, and the rib extends from the transverse bridge to the second bridge.

11. An oil pan assembly as claimed in claim 10 wherein each of the bridges comprises an upper wall portion and a lower wall portion extending downwards from a side of the upper wall portion, and the rib extends continuously between the upper wall portions of the bridges.

12. An oil pan assembly as claimed in claim 11 wherein the main member comprises another rib, one of the ribs is a first rib projecting from the first side wall section toward the second side wall section, the other of the ribs is a second rib projecting from the second side wall section toward the first side wall section, a width of the first rib is smaller than a width of the second rib, the first side wall section is located on a first lateral side on which a crankpin descends with revolution of a crankshaft, and the second side wall is located on a second lateral side on which the crankpin ascends with revolution of the crankshaft.

13. An oil pan assembly as claimed in claim 12 wherein the first rib comprises a corner bracing the first side wall and one of the bridges, and the corner is formed with an oil level gauge through hole.

14. An oil pan assembly for an internal combustion engine, comprising:

a tank member comprising a deep bottom defining a deep interior space section for storing a lubricating oil;

a main member comprising a shallow bottom defining a shallow interior space section for collecting the oil, and an upright wall enclosing an oil receiving interior space comprising the shallow interior space section and a bottomless open interior space section for leading the oil from the shallow interior space section into the deep space section, the bottomless open interior space section opening downwards into the deep interior space section; and wherein the upright wall comprises first and second opposite side wall sections extending in a first direction and bounding the shallow interior space section and the bottomless open space section between both side wall sections; and wherein the main member further comprises a transverse bridge extending from the first side wall section to the second side wall section across the bottomless open space section, and a thin wall rib extending in the first direction and connecting the bridge and one of the first and second side wall sections.

15. An oil pan structure as claimed in claim 14 wherein the upright wall of the main member comprises an upper flange for fastening the oil pan assembly by bolting to a lower side of a cylinder block of the internal combustion engine, the main member is in a form of a casting, the tank member is in a form of a formed metal sheet, the first direction is a longitudinal direction of the engine, the bridge extends in a second direction which is a transverse direction of the engine and connects the first and second side wall sections, and the bridge and rib are integral parts of the casting.

16. An oil pan assembly as claimed in claim 15:

wherein the main member comprises two of the thin wall ribs, one of the ribs is a first rib projecting from the first side wall section in the second direction and connecting the bridges by extending in the first direction between the bridges, and the other of the ribs is a second rib projecting from the second side wall section in the second direction and connecting the bridges by extending in the first direction between the bridges;

wherein a width of the first rib measured along the second direction is smaller than a width of the second rib;

wherein the first rib comprises a corner reinforcement defining an oil gauge hole and connecting the bridge and the first side wall section; and wherein the main member comprises two of the bridges each of which comprises an upper wall portion having an upwardly facing strip surface and a vertical wall portion extending downwards from one side of the upper wall portion, and each of the ribs forms a smooth continuous surface with the upper wall portions of the bridges.

17. An oil pan assembly for an internal combustion engine, comprising:

a tank member defining a deep interior space section for storing a lubricating oil; and an upper frame comprising a shallow bottom and an upright wall defining a shallow interior space section for collecting the oil and directing the oil into the deep section;

wherein the upright wall comprises first and second opposite side wall sections extending in a longitudinal direction, a first end wall section connecting first ends of the first and second side wall sections and a second end wall section connecting second ends of the first and second side wall sections, the shallow bottom extends from the second end wall section in the longitudinal direction toward the first end wall section and terminates at a bottom end extending in a transverse direction from the first side wall section to the second side wall section at an intermediate position between the first and second end wall sections;

wherein an opening for leading the oil from the shallow space section to the deep space section is framed between the first and second side wall sections along the transverse direction and between the first end wall section and the bottom end along the longitudinal direction; and wherein the oil pan assembly further comprises a transverse bridge extending in the transverse direction across the opening and connecting the first and second side wall sections, and a longitudinal projection extending in the longitudinal direction and bracing the bridge and the frame.

18. An oil pan assembly as claimed in claim 17:

wherein the frame, bridge and longitudinal projection are all integral parts of a metal casting;

wherein the longitudinal projection extends in the opening and connects the bridge with one of the upright wall and the shallow bottom of the frame;

wherein the longitudinal projection is one of a horizontal thin wall projection projecting in the transverse direction from the upright wall and a vertical thin wall projection projecting upwards from the shallow bottom;

wherein the oil pan assembly comprises two of the longitudinal projections extending in parallel to each other in the opening and forming an oil passage therebetween for allowing the lubricating oil to fall into the deep section;

wherein the bridge comprises an upper thin wall portion having an upwardly facing strip surface which extends from the first side wall section to the second side wall section and which is depressed at a middle between the first and second side wall sections, and a vertical thin wall portion extending downwards from one side of the upper thin wall portion; and wherein each of the first and second side wall sections is formed with a supporting boss defining a vertically extending bolt hole, and the bridge comprises a first bridge end connected with, and supported by, the supporting boss of the first side wall section and a second bridge end connected with, and supported by, the supporting boss of the second side wall section.

19. An oil pan assembly as claimed in claim 18 wherein the upper frame is formed with a plurality of the longitudinal projections each of which is a flow regulating barrier projecting upwards from the shallow bottom and comprising a forward thin wall end portion projecting beyond the bottom end of the shallow bottom into the opening, extending vertically, supporting the bridge at an intermediate point between the first and second bridge ends, and separating a plurality of bent oil passages leading the oil from the shallow section into the deep section.

20. An oil pan assembly as claimed in claim 19 wherein the upper frame is formed with two of the transverse bridges, one of the bridges is a U beam comprising the upper wall portion, two of the vertical wall portions extending downwards from both sides of the upper wall portion, a first beam end supported by the first side wall section and a second beam end supported by the second side wall section, and the other of the bridges is an L beam comprising the vertical wall portion, the upper wall portion projecting toward the second end wall section from an upper end of the vertical wall portion of the L beam, a first beam end supported by the first side wall section and a second beam end supported by the second side wall section, and wherein the forward thin wall end portion of each flow regulating barrier comprises a forward end connected with the vertical wall portion of the L beam and an upper end connected with the upper wall portion of the L beam.

21. An oil pan assembly as claimed in claim 20 wherein the upper frame is further formed with first and second longitudinal thin wall ribs projecting, respectively, from the first and second side wall sections toward each other, and connecting the upper wall portions of the U and L beams continuously, and a width of the first rib is smaller than a width of the second rib measured along the transverse direction.

* * * * *